United States Patent [19]

Audet

[11] Patent Number: 4,887,627

[45] Date of Patent: Dec. 19, 1989

[54] SHELTER WITH RELEASABLE BALLAST MEMBERS

[75] Inventor: Carol Audet, Laval, Canada

[73] Assignee: Les Piscines Et Abris Tempo, Inc., Laval, Canada

[21] Appl. No.: 281,727

[22] Filed: Dec. 9, 1988

[51] Int. Cl.[4] ..... E04H 15/32

[52] U.S. Cl. ..... 135/120; 135/87; 52/2 N

[58] Field of Search ..... 135/120, 87, 118; 52/2 N, 2 P

[56] References Cited

U.S. PATENT DOCUMENTS

| | | | |
|---|---|---|---|
| 1,986,140 | 1/1935 | Dapp . | |
| 2,036,033 | 3/1936 | Fisher | 135/118 |
| 2,134,879 | 11/1938 | Levy . | |
| 2,652,845 | 9/1953 | O'Neill et al. | 135/120 |
| 3,448,748 | 6/1969 | Walrave | 135/120 |
| 3,841,631 | 10/1974 | Dolan . | |
| 4,000,749 | 1/1977 | Busco . | |
| 4,109,910 | 8/1978 | Gleason . | |
| 4,148,455 | 4/1979 | Oliver . | |
| 4,195,877 | 4/1980 | Duda | 135/120 |
| 4,296,693 | 10/1981 | Archer . | |
| 4,625,468 | 12/1986 | Hampel | 52/2 N |

FOREIGN PATENT DOCUMENTS 838446 4/1970 Canada .

*Primary Examiner*—David A. Scherbel
*Assistant Examiner*—Caroline D. Dennison
*Attorney, Agent, or Firm*—James W. Hellwege

[57] ABSTRACT

An improved portable and foldable shelter comprising a structure of tubular members and cross-members forming an assembly having side walls preferably tapered inwardly, a roof or top, and a covering complementary in shape to the assembled structure. Elongated containers are secured to the walls of the shelter and are capable of receiving a heavy substance such as water, sand or elongated segments of heavy material. The containers may be elongated pockets, secured to or incorporated to the shelter, preferably to the covering or incorporated in the side walls of the covering, and located substantially at the lower end of the side wall adjacent to the supporting surface so that the lower portion of the containing means may be close to or touch the supporting surface thus preventing the passage of air or wind underneath the side walls or the floor of the shelter.

10 Claims, 2 Drawing Sheets

SHELTER WITH RELEASABLE BALLAST MEMBERS

Figure 1:
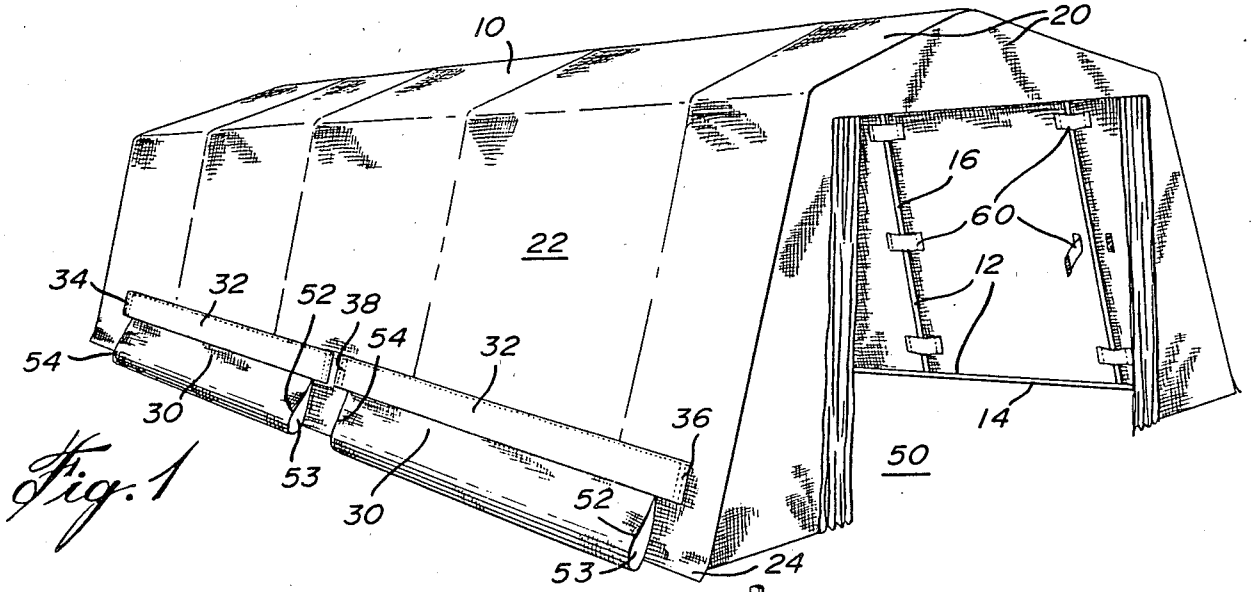

The invention relates to a portable and foldable shelter used normally on a temporary, seasonal or periodical basis primarily outdoor, although it could also be used indoors. For example, a shelter contemplated by or suitable for the present invention would be a camping tent, a garage, an entrance sidewalk cover and where the configuration of the floor of the shelter may be rectangular, square or round.

Generally these shelters are made of a structure which is an assembly of tubular members and cross-members covered by a suitable material such as canvas, synthetic fabric or the like selected in consideration for the use contemplated.

The conventional shelters of the prior art need to be anchored in the ground to stabilize the structure. Often additional retention of the covering by cables tied to anchor pegs is necessary to retain the covering over the structure, preventing it from being blown away and to stabilize the shelter at the selected location of its assembly and installation.

These conventional shelter retention means have the disadvantage of not being suitable for all types of grounds. In some instances, one cannot use anchor pegs to secure or fasten the structure and the covering to a solid surface made of concrete, asphalt, wood or rock. In other instances softer grounds also present some difficulties where the shelter is mounted on sand, earth, grass or other soil that is too soft to retain solidly a peg planted in it. Furthermore the installation of cables and pegs to retain the covering calls for a larger area than that of the shelter, may block a passage way around or adjacent to the shelter and may constitute a danger for a person walking around the shelter in the dark with the risk of tripping over a peg, cable line or other retention means.

Attempts have been made to overcome these disadvantages in using heavy objects such as rocks, concrete blocks, heavy beams sitting over the covering material when the covering walls extend sufficiently over the ground to allow such positioning of these objects over it. Nevertheless, the use of these objects does not prevent the wind blowing under the shelter or its floor nor the sharp edges of the objects damaging or ripping the covering, the danger of people tripping over these objects and finally the inconvenience of storing these objects away when the shelter is disassembled for storage.

It is an object of the present invention to provide a shelter that has improved features over the prior and known art and particularly adapted to provide a shelter stable and self-supporting on different surfaces and substantially eliminating anchor means and retention cables in normal conditions.

It is a further object of the invention to provide means whereby the wind penetration under the shelter side walls or floor is substantially reduced.

According to the present invention, there is provided an improved portable and foldable shelter comprising a structure of tubular member and cross-member assembly, said assembly having side walls preferably tapered inwardly, a roof or top, and a covering complementary in shape to the assembled structure, the improvement characterized in that elongated container means are secured to the walls of the shelters said container means being capable of receiving a heavy substance therein such as water, sand or elongated segments of heavy material.

In another embodiment of the invention, the container means may be elongated pockets, secured to or incorporated to the shelter, preferably to the covering or incorporated in the side walls of the covering, and located substantially at the lower end of the side wall adjacent to the supporting surface so that the lower portion of the containing means may be close to or touch the supporting surface thus preventing the passage of air or wind underneath the side walls or the floor of the shelter.

While elongated vertical container means secured to the shelter along the side walls in fastened relation to vertical tubular members of the structure and the covering may provide the desired stability, it may still allow occasional wind penetration underneath the side wall or floor of the shelter.

The container means or/enclosure in the form of a pocket, a bag or a reservoir may vary in accordance with the type of shelter, its configuration, the use contemplated for the shelter, the substance to be inserted in the pocket, the mode of securing the container means to the shelter, either to the covering, the supporting structure or both.

Another sealed reservoir may be inserted inside the pocket, capable of receiving and retaining water, providing water expansion inside the pocket in freezing temperature.

The enclosure may be made of a section of the covering fabric folded in two to provide two vertical walls. The upper portion of said enclosure vertical walls may be secured to a retention member either incorporated to the side wall of the covering or associated with a horizontal tubular member of the structure suitably located in relation thereto.

While the opposite vertical ends of the folded section forming the enclosure may remain open to allow insertion of heavy elongated members therein to provide one of the form of use contemplated, it is preferred to close, fasten or seal the said two opposite ends to allow insertion and retention of a fluid substance such as water or sand. Suitable inlet and outlet apertures should be provided to fill the enclosure in setting-up the shelter or to empty it in preparing it for storage.

It is appreciated that the vertical and horizontal dimension of each enclosure and the number of enclosures distributed around the shelter will be in relation to the overall dimension of the shelter and its area.

A preferred embodiment of the invention is described below with reference to the accompanying drawings.

FIG. 1: is an isometric view of a shelter with structure, covering and container means.

Figure 2:
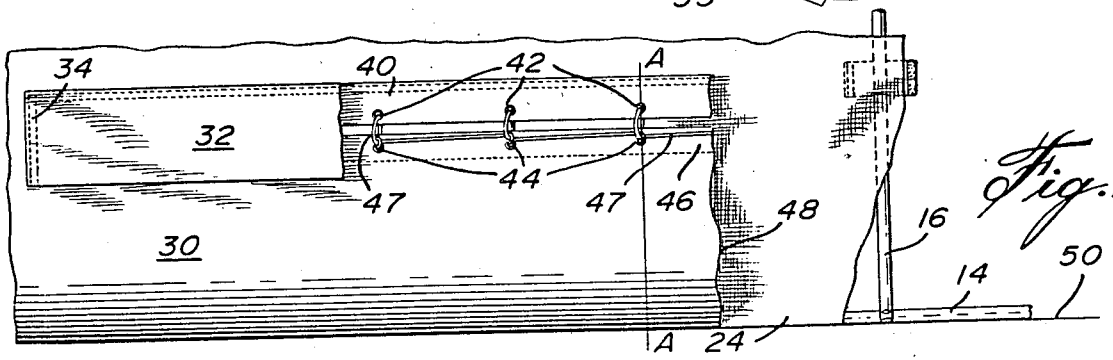

FIG. 2: is a detailed view showing the attachment of a pocket to the side wall with the protecting flap in a cut away section representation.

Figure 3:
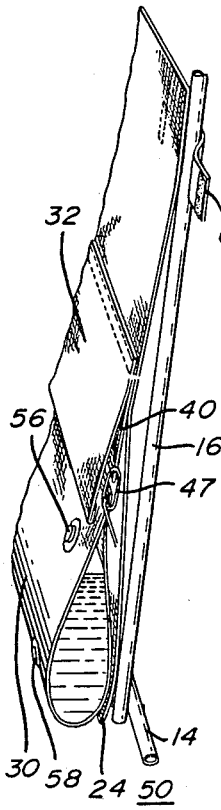

FIG. 3: is a cross-sectional view in elevation of an embodiment of the invention, the cross-section being taken along line A—A of FIG. 2.

Figure 4:
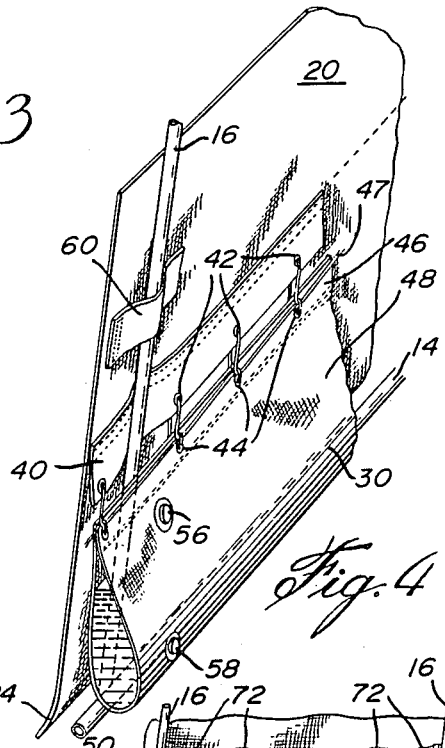

FIG. 4: is a detailed view of an alternative embodiment with the pocket located inside the shelter.

Figure 5:
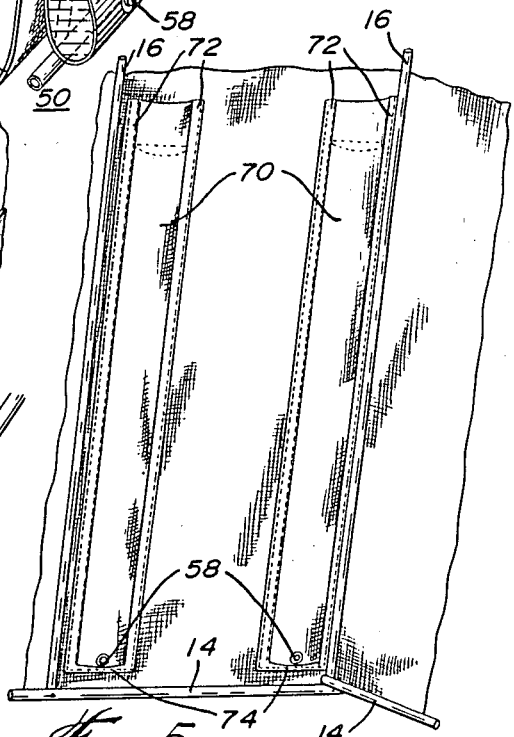

FIG. 5: is a cross sectional view of an alternative embodiment in the vertical pocket inside the side wall.

Figure 6:
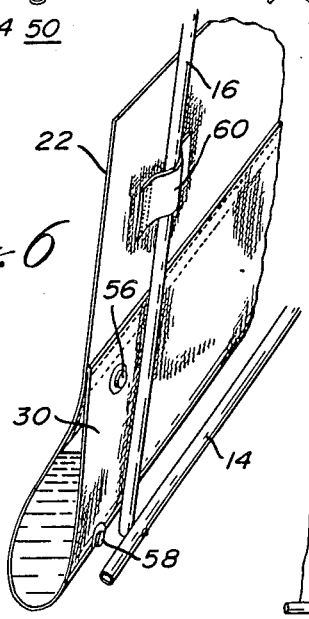

FIG. 6: is a cross sectional view of an alternative embodiment in the pocket integrated to the side wall of the shelter in a vertical position.

In a well known manner in the prior art, the shelter (10) comprises a structure (12) made of tubular members, horizontal (14), vertical (16) and bridging elements at the top to make the roof and a covering (20) with side walls (22) of a complementary form in dimension and shape and disposed over and around the structure (12).

As can be seen from FIGS. 2 and 3, at the lower portion of the side wall (22) one or more pockets (30) are secured under a flap (32), which flap is sewn at both ends (34) and (36) and in the middle thereof (38). The flap may be made from an outward extension of the side wall of the covering, longitudinally folded upon itself and sewn together.

Underneath the flap (32), a narrower longitudinal strip (40) is provided and is attached to the side wall 22. The strip (40) contains a series of equidistant holes (42) reinforced by metal rings to provide attachment of the pocket to the side wall. The lower end (24) of the side wall of the covering reaches downwardly to complete the side wall so that the border thereof is adjacent to or touches the supporting surface (50).

The pocket (30) is made preferably of the same fabric as the covering (20). A piece of elongated fabric is folded in two along its length and is sewn together to form a flat tube. The longitudinal edges are stitched together and form a narrow longitudinal strip (46) along the edge of the so formed flat tube. The remainder of the tube is the container portion (48). The width of this strip (46) is about the same as the width of the strip (40). A series of equidistant holes (44) is made in the strip (46) in locations corresponding to the distances between the holes (42) in the strip (40). The opposite ends (52) and (54) of the pocket are fastened or sewn together. A segment of fabric (53) may be inserted and fastened in the opposite ends (52 and 54) to provide greater volume to the pocket (30). In each pocket (30), there is provided an opening (56) at the top thereof to receive a fluid such as water and another hole (58) with a closing device, such a plug or other suitable means is at the lower end of each pocket (30) to drain the pocket for eventual storage. The inlet (56) and outlet (58) openings or holes may vary in size and location depending on the substance that is contemplated to be inserted therein.

In an alternative embodiment, the pocket (30) is made of a sheet of fabric, folded in two along its longitudinal edges and both ends (52) and (53) are fastened together. The upper ends of each side or wall of the pocket are folded and sewn to form two narrow strips of about the same width as the strips (40) or (46) and in each of which, a series of equidistant holes (42) and (44) are respectively made.

Each of the pockets (30) of the first or alternative embodiment is attached or secured to the covering with strings (47) passing from the holes (42) of the strip (40) through the holes (44) of the strips (46) at the top of the pocket.

In another mode of construction, the first strip (40) is made or secured inside the side wall (22) and thus the pocket may be attached inside the structure of the shelter as shown in FIG. 4. In this instance, the outside flap (32) may be eliminated. Furthermore, the structural horizontal members (14) or another similar cross member may be located above the ground at about the level of the first strip (40) inside the covering and the first strip (40), the second strip (46) of the pocket and the horizontal cross-member (14) are all tied together with strings (47). In another version, the pocket (30) may be tied to the raised cross-member (14) to eliminate the flap (32) and the first strip (40). To avoid the covering being blown away from the structure of the shelter, a number of retention bands (60) are sewn inside the covering at numerous locations, corresponding to the vertical and horizontal cross-members of the structure and the said bands are tied to the structure, thus retaining the covering on the structure.

In another version shown in FIG. 5, elongated vertical pockets (70) may be incorporated to the side wall 22 of the covering. They are made from longitudinal bands of fabric sewn to the side walls in a vertical fashion at locations corresponding to at least each corner of the shelter. In making the distance between two vertical seams (72) smaller than the width of the band of fabric, and sewing the lower end (74) to the side wall, one thus forms a vertical pocket (70). A hole and plug (58) at the bottom of each pocket may serve to empty the water used to stabilize the structure or another closing device more suitable to empty sand may be used.

Such pockets (70) should be located at least at each corner and others at intermediate distances along the side walls adjacent to vertical tubular members (16), taking into consideration the size of the shelter and the dimension of the side walls.

In another fully integrated version as shown in FIG. 6, the pocket (30) is made from an extension of the side wall material folded inside the side wall (22) and fastened or sewn to the side wall to form a pocket of about the same dimension as pocket (30) already described. Opposite ends (36) and (38) are sewn together, openings (56) at the top and holes (58) and plugs at the bottom are made to provide water and sand inlets and outlets. This simpler structure eliminates the flaps (30), the strips (40), the holes (42) and the strings (47) as well as many expensive production operations and material. While it is satisfactory, it does not provide the additional advantage of the removal or the replacement of the pocket for repair or maintenance, should one accidentally be punctured or damaged.

For rectangular shelters, it has been found satisfactory to have pockets covering substantially both opposite longitudinal side walls of the shelter, preferably $\frac{3}{4}$ of the length of the side wall. For other structure configuration, whether square or round, the pockets should cover about half the periphery of the shelter and be located at a distance one to another to provide a balanced distribution.

It is to be appreciated that the number of pockets may be increased by a number of vertical seams therein and the addition of inlets and outlets. Many other variations may be made in dimension, manufacture, location and attachment of the pockets within the scope of the present invention. Without departing from the spirit of the invention or the scope of the appended claim and therefore, I do not wish to be limited in my invention except as set forth hereinafter in the appended claim.

The embodiments of the invention in which an exclusive property or privilege is claimed are defined as follows:

1. A portable knock down shelter assembly having a skeleton frame structure of detachable tubular rib members and cross members and a covering complementary in shape to said structure, said shelter assembly defining a roof and substantially vertical walls having upper and lower portions with the lower portion adapted to be adjacent the ground when the shelter is assembled; one or more modular ballast members with each modular member being a separate container in the form of an elongated flat tube having closed ends and a fastening strip formed along an upper portion of the tube along the length thereof, inlet means in the so formed container adjacent the fastening strip for filling the container with ballast material; said lower portions of said walls being provided with attachment means for removably attaching said one or more ballast members to the walls of the shelter when assembled, said attachment means including engagement means located for engaging the fastening strip on the one or more ballast members whereby the one or more ballast members may be provided at predetermined locations on the lower portion of the walls to anchor the walls and thus the shelter to the ground when the shelter is assembled.

2. A shelter in accordance with claim 1 wherein the attachment means on the walls of the shelter comprise a longitudinal horizontal strip secured to the lower portion of said walls, said strip having a series of spaced apart holes therein; said fastening strip of said one or more modular ballast member including holes therein located at spaced apart locations adapted to be aligned with the holes in the said longitudinal horizontal strip on said wall and detachable retaining means passing through aligned holes to secure the said one or more ballast member to the said longitudinal horizontal strip on the wall.

3. A shelter in accordance with claim 2 wherein the tube forming the container is an impermeable fabric and the top and opposite ends of the said tube are closed in a sealed fashion to constitute a container capable of receiving and retaining a fluid substance.

4. A shelter in accordance with claim 3 wherein the said container has at the top thereof said inlet to receive the fluid substance and at the bottom thereof an outlet closing device is provided whereby the fluid substance can be drained.

5. A shelter in accordance with claim 4 wherein the said longitudinal horizontal strip on said wall is outwardly secured to the side wall of the shelter.

6. A shelter in accordance with claim 4 wherein the longitudinal horizontal strip on said wall is inwardly secured to the said wall relative to the shelter assembly.

7. A shelter in accordance with claim 6 wherein the modular ballast members are secured to the longitudinal horizontal strip of the wall and to a horizontal cross member of the said frame structure adjacently located to the said longitudinal horizontal strip.

8. A shelter in accordance with claim 4, wherein the fluid substance is selected from the group consisting of water and sand.

9. A shelter in accordance with claim 2, wherein the said one or more ballast members are outwardly secured to the lower portion of the walls so that the lower extremity of the said one or more ballast members extend slightly beyond the lower extremity of the said walls, providing the one or more ballast members when filled with a heavy substance to contact the supporting surface of the shelter, and preventing the wind from having substantial access under the said walls of the shelter.

10. A shelter in accordance with claim 2, wherein an elongated flap of rectangular configuration extends and covers the longitudinal horizontal strip on the wall and is fixed to the walls immediately above the said longitudinal horizontal strip on the walls and at its end edges, the said flap extending over the said longitudinal horizontal strip and the fastening strip of the one or more ballast members and the retaining means.

* * * * *